US005673718A

United States Patent [19]

Kennedy

[11] Patent Number: 5,673,718

[45] Date of Patent: Oct. 7, 1997

[54] GOLF CLUB UMBRELLA HANGER

[76] Inventor: Kevin R. Kennedy, 23 Highridge Rd., Willowbrook, Ill. 60514

[21] Appl. No.: 349,302

[22] Filed: Dec. 5, 1994

[51] Int. Cl.[6] ..... A63B 57/00

[52] U.S. Cl. ..... 135/16; 248/309.1; 248/317; 273/32 E

[58] Field of Search ..... 248/102, 103, 248/309.1, 311.2, 311.3, 315, 317, 318, 320; 273/32 E; 211/70.2; 135/16

[56] References Cited

U.S. PATENT DOCUMENTS

| | | | |
|---|---|---|---|
| 484,335 | 10/1892 | Moss | 248/317 X |
| 1,819,912 | 8/1931 | McGaffey | 135/16 |
| 2,043,019 | 6/1936 | Swasey | 135/16 |
| 2,514,134 | 7/1950 | Mann | 248/102 |
| 2,743,894 | 5/1956 | Ostnas | 248/317 |
| 2,887,137 | 5/1959 | Robb | 211/70.2 |
| 3,269,683 | 8/1966 | Shinaver | 248/318 X |
| 3,397,795 | 8/1968 | Elting | 248/317 X |
| 3,483,996 | 12/1969 | Scammon . | |
| 4,079,909 | 3/1978 | Einhorn | 248/318 |
| 4,154,255 | 5/1979 | Weaver | 135/16 |
| 4,170,333 | 10/1979 | Angelastro . | |
| 4,519,566 | 5/1985 | Manzi . | |
| 4,586,524 | 5/1986 | Smith . | |
| 4,961,555 | 10/1990 | Egan, Jr. | 248/311.2 X |

*Primary Examiner*—Leslie A. Braun
*Assistant Examiner*—Derek J. Berger
*Attorney, Agent, or Firm*—Hill, Steadman & Simpson

[57] ABSTRACT

A hanger for suspending a golf club beneath an umbrella. The inventive device includes a mounting assembly for securing to the umbrella. An elongated main body is coupled to the mounting assembly and extends downwardly therefrom to terminate in an engaging assembly for coupling to a golf club to suspend the golf club beneath the umbrella.

13 Claims, 3 Drawing Sheets

GOLF CLUB UMBRELLA HANGER

BACKGROUND OF THE INVENTION

1. Field of the Invention

The present invention relates to mounting devices and more particularly pertains to a golf club umbrella hanger for suspending a golf club beneath an umbrella.

2. Description of the Prior Art

The use of mounting devices is known in the prior art. More specifically, mounting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art mounting devices include U.S. Pat. No. 4,170,333; U.S. Pat. No. 4,519,566; U.S. Pat. No. 3,483,996; and U.S. Pat. No. 4,586,524.

While these devices fulfill their respective, particular objectives and requirements, the aforementioned patents do not disclose a golf club umbrella hanger for suspending a golf club beneath an umbrella which includes a mounting means for securing to an umbrella, and an elongated main body coupled to the mounting assembly and extending downwardly therefrom to terminate in an engaging means for coupling to a golf club to suspend the golf club beneath the umbrella.

In these respects, the golf club umbrella hanger according to the present invention substantially departs from the conventional concepts and designs of the prior art, and in so doing provides an apparatus primarily developed for the purpose of suspending a golf club beneath an umbrella.

SUMMARY OF THE INVENTION

In view of the foregoing disadvantages inherent in the known types of mounting devices now present in the prior art, the present invention provides a new golf club umbrella hanger construction wherein the same can be utilized for suspending a golf club beneath an umbrella. As such, the general purpose of the present invention, which will be described subsequently in greater detail, is to provide a new golf club umbrella hanger apparatus and method which has many of the advantages of the mounting devices mentioned heretofore and many novel features that result in a golf club umbrella hanger which is not anticipated, rendered obvious, suggested, or even implied by any of the prior art mounting devices, either alone or in any combination thereof.

To attain this, the present invention generally comprises a hanger for suspending a golf club beneath an umbrella. The inventive device includes a mounting assembly for securing to the umbrella. An elongated main body is coupled to the mounting assembly and extends downwardly therefrom to terminate in an engaging assembly for coupling to a golf club to suspend the golf club beneath the umbrella.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf club umbrella hanger apparatus and method which has many of the advantages of the mounting devices mentioned heretofore and many novel features that result in a golf club umbrella hanger which is not anticipated, rendered obvious, suggested, or even implied by any of the prior art mounting devices, either alone or in any combination thereof.

It is another object of the present invention to provide a new golf club umbrella hanger which may be easily and efficiently manufactured and marketed.

It is a further object of the present invention to provide a new golf club umbrella hanger which is of a durable and reliable construction.

An even further object of the present invention is to provide a new golf club umbrella hanger which is susceptible of a low cost of manufacture with regard to both materials and labor, and which accordingly is then susceptible of low prices of sale to the consuming public, thereby making such golf club umbrella hangers economically available to the buying public.

Still yet another object of the present invention is to provide a new golf club umbrella hanger which provides in the apparatuses and methods of the prior art some of the advantages thereof, while simultaneously overcoming some of the disadvantages normally associated therewith.

Still another object of the present invention is to provide a new golf club umbrella hanger for suspending a golf club beneath an umbrella such that the golf club is precluded from becoming wet as a result of rain impinging thereon.

Yet another object of the present invention is to provide a new golf club umbrella hanger which includes a mounting means for securing to an umbrella, and an elongated main body coupled to the mounting assembly and extending downwardly therefrom to terminate in an engaging means for coupling to a golf club to suspend the golf club beneath the umbrella.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
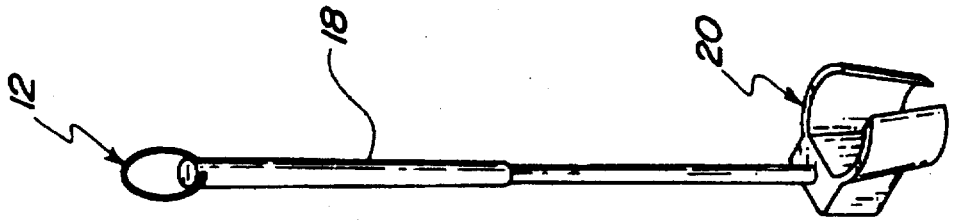
FIG. 2 is an isometric illustration of the invention, per se.

With reference now to the drawings, and in particular to FIGS. 1–6 thereof, a new golf club umbrella hanger embodying the principles and concepts of the present invention and generally designated by the reference numeral 10 will be described.

More specifically, it will be noted that the golf club umbrella hanger 10 comprises a mounting means 12 for securing to a portion of an umbrella 14, such as a support rod 16 extending therebeneath. An elongated main body 18 is coupled to the mounting means 12 so as to depend therefrom. The elongated main body 18 terminates in a lower distal end whereat an engaging means 20 is secured for engaging a golf club 22. The present invention 10 operates to suspend the golf club 22 beneath the umbrella 14 to preclude the golf club from getting wet.

Figure 1:
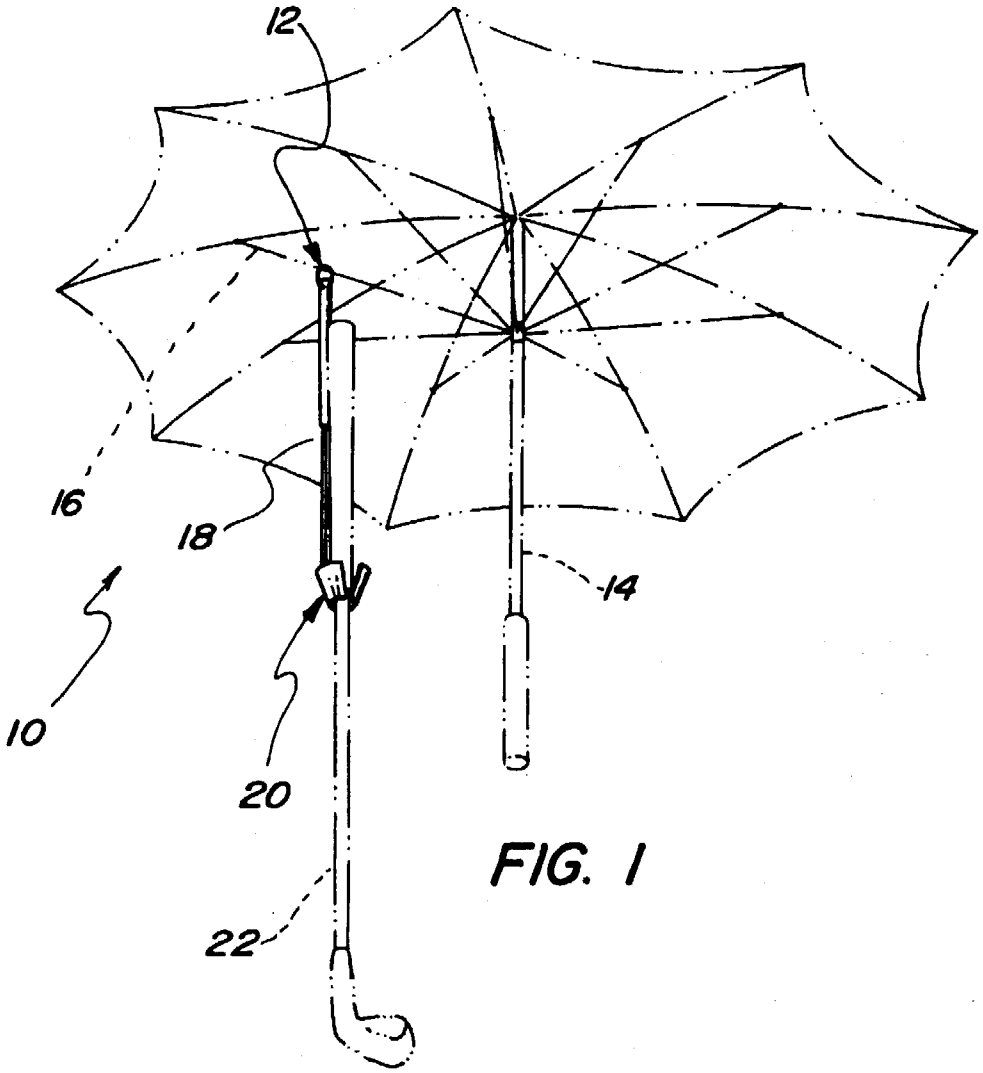
FIG. 1 is an isometric illustration of a golf club umbrella hanger according to the present invention in use.
Figure 5:
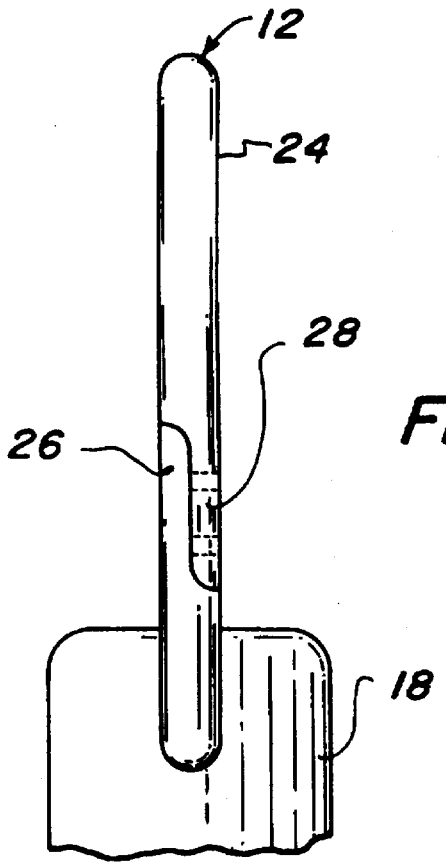
FIG. 5 is a side elevation view taken from line 5—5 of FIG. 3.
Figure 6:
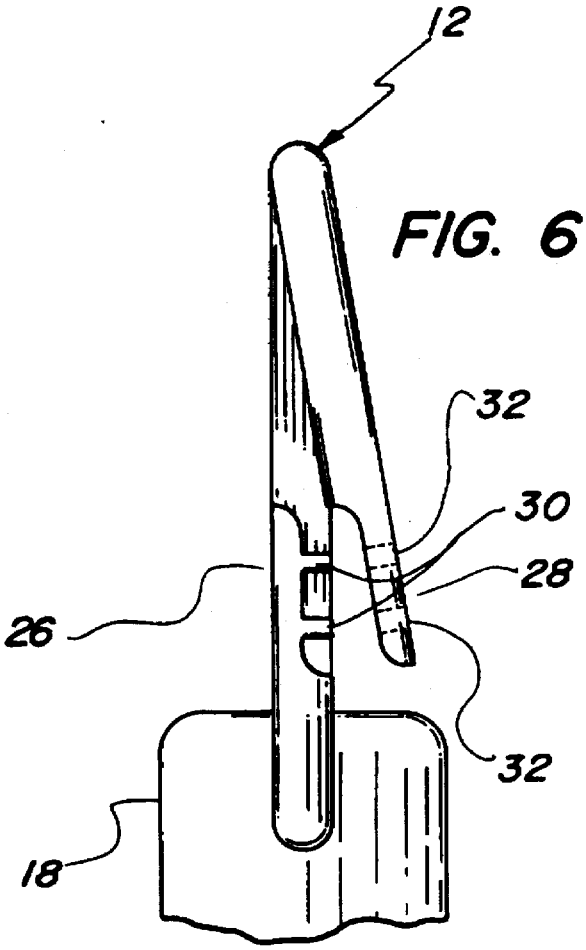
FIG. 6 is a further side elevation view a mounting means of the present invention.

As best illustrated in FIGS. 5 and 6, it can be shown that the mounting means 12 according to the present invention 10 preferably comprises a releasable clip ring 24 pivotally mounted to an upper end of the elongated main body 18. To this end, the releasable clip ring 24 is directed through a portion of the elongated main body 18. The releasable clip ring 24 is shaped so as to define a first offset portion 26 positioned into abutting engagement with a second offset portion 28. As shown in FIG. 6, the first offset portion 26 includes at least one projection 30 extending laterally therefrom which enters at least one aperture 32 formed in the second offset portion 28. Thus, the second off set portion 28 can be selectively biased out of a plane within which the releasable clip ring 24 is residing to permit separation of the projection 30 from the aperture 32 during coupling of the releasable clip ring 24 to the support rod 16 of the umbrella 14 as shown in FIG. 1.

Figure 3:
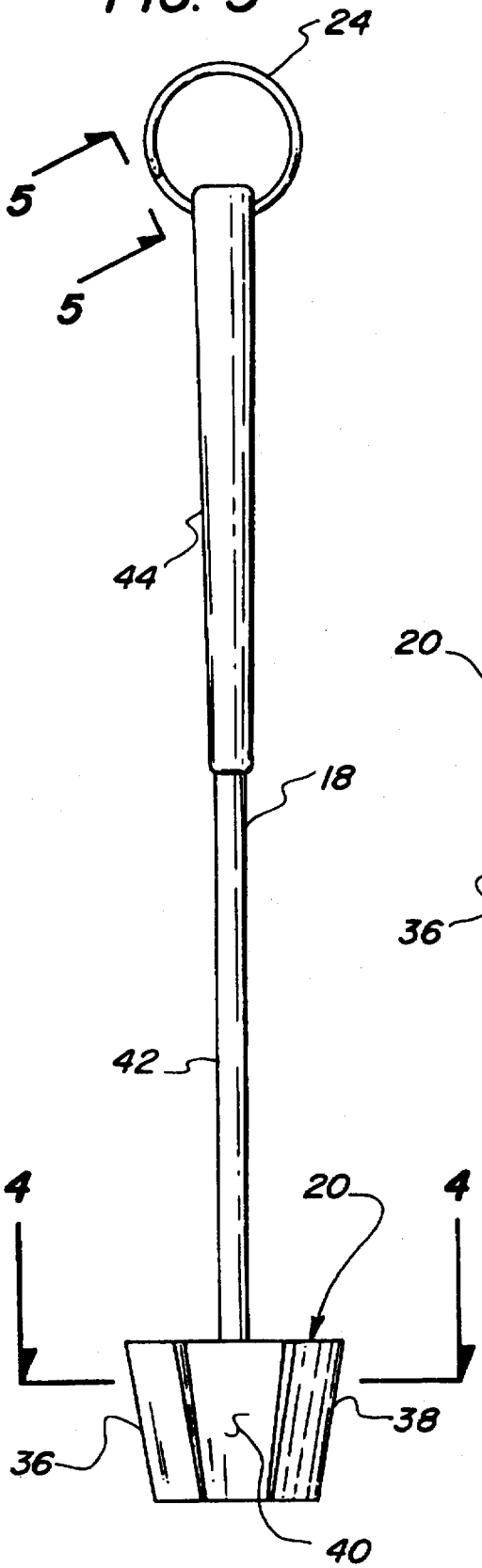
FIG. 3 is a front elevation view of the invention.
Figure 4:
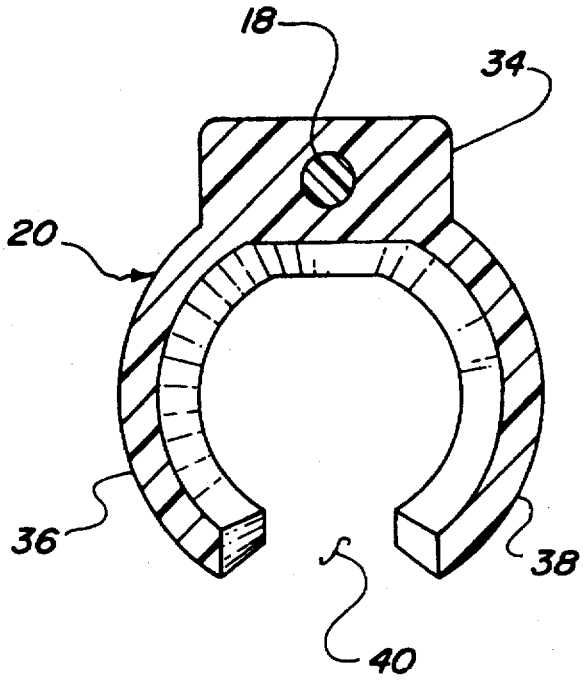
FIG. 4 is a cross sectional view taken along line 4—4 of FIG. 3.

Referring now to FIGS. 3 and 4, it can be shown that the engaging means 20 preferably comprises a mounting block 34 mounted to the lower distal end of the elongated main body 18. A first arcuate member 36 projects from the mounting block 34. Similarly, a second arcuate member 38 projects from the mounting block 34. The arcuate members 36 and 38 terminate in a pair of spaced ends defining a center slot 40 through which a shaft of the golf club 22 can be positioned. The arcuate members 36 and 38 are tapered such that a first distance between the arcuate member proximal to an upper end of the engaging means 20 is substantially greater than a second distance between the arcuate members proximal to a lower end of the engaging means. Thus, a golf club 22 positioned between the arcuate member 36 and 38 will be engaged thereby as the shaft of the golf club is allowed to extend therethrough due to the tapered shape of the golf club shaft. Preferably, the arcuate members 36 and 38 are spaced such that they engage a handle of the golf club 22.

As shown in FIG. 3, the elongated main body 18 is preferably shaped so as resemble a portion of a golf club and includes a shaft portion 42 to which the mounting block 34 of the engaging means 20 is secured. The shaft portion 42 extends into a handle grip portion 44, with the releasable clip ring 24 of the mounting means 12 extending through the handle grip 44 as described above.

In use, the golf club umbrella hanger 10 according to the present invention can be easily coupled to a support rod 16 of an umbrella 14, with a golf club 22 being easily positionable into the engaging means 20, whereby the golf club is suspended beneath the umbrella to preclude an impinging of rain or like fluids thereon. The device 10 thus operates to maintain a handle of the golf club 22 in a dry condition to improve safety on the golf course.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A golf club umbrella hanger comprising:

an elongated hanger body having an upper end and a lower distal end;

means provided at said upper end of said hanger body for securing the hanger body to at least one strut of an umbrella;

means provided at the lower distal end of the hanger body for engaging a golf club to suspend the golf club beneath the umbrella;

said securing means further comprising a releasable clip ring pivotally mounted to the upper end of the hanger body;

said engagement means further comprising a mounting block mounted to the lower distal end of the elongated hanger body; a first arcuate member projecting from the mounting block; and a second arcuate member projecting from the mounting block, the arcuate members terminating in a pair of spaced ends defining a center slot through which a shaft of a golf club can be positioned;

said arcuate members being tapered such that a first distance between the arcuate members proximal to an upper end of the engaging means is substantially greater than a second distance between the arcuate members proximal to a lower end of the engaging means; and said releasable clip ring being shaped so as to define a first offset portion positioned into abutting engagement with a second offset portion, the first offset portion including at least one projection extending laterally therefrom which enters at least one aperture formed in the second offset portion such that the second offset portion can be selectively biased out of a plane within which the releasable clip ring is residing to permit separation of the projection from the aperture during coupling of the releasable clip ring to an umbrella.

2. The golf club umbrella hanger of claim 1, wherein the elongated hanger body is shaped so as resemble a portion of a golf club and includes a shaft portion to which the mounting block of the engaging means is secured, the shaft portion extending into a handle grip portion, with the releasable clip ring of the mounting means extending through the handle grip portion.

3. An umbrella and golf club hanger combination, said combination comprising: an umbrella having a shaft, a cover, and a plurality of struts extending between the shaft and the cover;

an elongated hanger body having an upper end and a lower distal end;

means provided at said upper end of said hanger body for securing the hanger body to at least one of the plurality of struts of the umbrella; and means provided at said lower distal end of said hanger body for engaging a golf club to suspend the golf club beneath the umbrella.

4. The combination in claim 3, wherein the engaging means further comprises a mounting block mounted to the lower distal end of the elongated hanger main body; a first arcuate member projecting from the mounting block; a second arcuate member projecting from the mounting block, the arcuate members terminating in a pair of spaced ends defining a center slot through which a shaft of a golf club can be positioned.

5. The combination in claim 4, wherein the arcuate members are tapered such that a, first distance between the arcuate members proximal to an upper end of the engagement means is substantially greater than a second distance between the arcuate members proximal to a lower end of the engaging means.

6. The combination in claim 4 wherein the center slot is wide enough to permit a golf club shaft to pass therethrough but sufficiently narrow to prevent a golf club grip from passing therethrough.

7. The combination in claim 3, wherein the securing means comprises a releasable clip ring pivotally mounted to the upper end of the hanger body.

8. The combination in claim 7, wherein the releasable clip ring is shaped so as to define a first offset portion positioned into abutting engagement with a second offset portion, the first offset portion including at least one projection extending laterally therefrom which enters at least one aperture formed in the second offset portion such that the second offset portion can be selectively biased out of a plane within which the releasable clip ring is residing to permit separation of the projection from the aperture during coupling of the releasable clip ring to one of the plurality of struts of said umbrella.

9. An umbrella, golf club hanger, and golf club combination, said combination comprising:

an umbrella having a shaft, a cover, and a plurality of struts extending between the shaft and the cover;

an elongated hanger body having an upper end and a lower distal end;

means provided at said upper end of said hanger body for securing the hanger body to at least one of the plurality of struts of the umbrella;

means provided at said lower end of said hanger body for engaging a golf club to suspend the golf club beneath the umbrella; and a golf club having a grip and a shaft extending therefrom and being suspended beneath said umbrella by said engaging means.

10. The combination in claim 9, wherein the engaging means further comprises a mounting block mounted to the lower distal end of the elongated hinges body; a first arcuate member projecting from the mounting block; a second arcuate member projecting from the mounting block, the arcuate members terminating in a pair of spaced ends defining a center slot through which the shaft of the golf club can be positioned.

11. The combination in claim 10, wherein the arcuate members are tapered such that a first distance between the arcuate members proximal to an upper end of the engagement means is substantially greater than a second distance between the arcuate members proximal to a lower end of the engaging means.

12. The combination in claim 11, wherein the securing means comprises a releasable clip ring pivotally mounted to an upper end of the elongated hanger body.

13. The combination in claim 12, wherein the releasable clip ring is shaped so as to define a first offset portion positioned into abutting engagement with a second offset portion, the first offset portion including at least one projection extending laterally therefrom which enters at least one aperture formed in the second offset portion such that the second offset portion can be selectively biased out of a plane within which the releasable clip ring is residing to permit separation of the projection from the aperture during coupling of the releasable clip ring to an umbrella.

* * * * *